US009060223B2

(12) United States Patent
Bailey

(10) Patent No.: US 9,060,223 B2
(45) Date of Patent: Jun. 16, 2015

(54) METHOD AND CIRCUITRY FOR PROCESSING AUDIO SIGNALS

(71) Applicant: Aphex, LLC, Burbank, CA (US)

(72) Inventor: James L. Bailey, Pomona, CA (US)

(73) Assignee: APHEX, LLC, Burbank, CA (US)

( * ) Notice: Subject to any disclaimer, the term of this patent is extended or adjusted under 35 U.S.C. 154(b) by 256 days.

(21) Appl. No.: 13/788,845

(22) Filed: Mar. 7, 2013

(65) Prior Publication Data

US 2014/0254827 A1 Sep. 11, 2014

(51) Int. Cl.
*H04R 3/04* (2006.01)

(52) U.S. Cl.
CPC ..... *H04R 3/04* (2013.01)

(58) Field of Classification Search
None
See application file for complete search history.

(56) References Cited

U.S. PATENT DOCUMENTS

| | | | |
|---|---|---|---|
| 4,150,253 | A | 4/1979 | Knoppel |
| 4,400,583 | A | 8/1983 | Bloy |
| 4,584,700 | A | 4/1986 | Scholz |
| 5,133,015 | A | 7/1992 | Scholz |
| 5,359,665 | A | 10/1994 | Werrbach |
| 5,424,488 | A | 6/1995 | Werrbach |
| 5,483,600 | A | 1/1996 | Werrbach |
| 6,504,935 | B1 | 1/2003 | Jackson |
| 7,352,872 | B2 | 4/2008 | Neumann et al. |
| 7,388,959 | B2 | 6/2008 | Gagon |
| 7,640,069 | B1 | 12/2009 | Johnston |
| 7,647,226 | B2 | 1/2010 | Sato |
| 7,716,042 | B2 | 5/2010 | Schuller et al. |
| 7,729,903 | B2 | 6/2010 | Schuller et al. |
| 7,865,257 | B2 | 1/2011 | Fay et al. |
| 7,907,736 | B2 | 3/2011 | Yuen et al. |
| 8,009,834 | B2 | 8/2011 | Ko |
| 8,045,720 | B2 | 10/2011 | Neumann |

(Continued)

FOREIGN PATENT DOCUMENTS

| | | |
|---|---|---|
| EP | 111066 A2 | 6/1984 |
| EP | 0111066 A3 | 6/1984 |

(Continued)

OTHER PUBLICATIONS

Understanding and Using OTA OP-AMP ICs, Part 1 (Apr. 2003), Part 2 (May 2003), Ray Marston, Nuts & Volts.

(Continued)

*Primary Examiner* — Paul Huber
(74) *Attorney, Agent, or Firm* — Gordon & Jacobson, PC

(57) ABSTRACT

An audio signal processing method and circuitry that processes an input audio signal by filtering the input audio signal with a high pass filter to produce a filtered audio signal, which is input to a compressor. A first intermediate audio signal is produced based on the compressor output signal. The filtered audio signal is also input to a harmonics generator that produces harmonics of the filtered audio signal. A second intermediate audio signal is produced based on such harmonics. A third intermediate signal is produced based upon the input audio signal. An output audio signal is produced by combining the first intermediate audio signal, the second intermediate audio signal and the third intermediate audio signal. The compressor can be configured to reduce the dynamic range of components of the filtered audio signal that contribute to the first intermediate audio signal relative to the dynamic range of the harmonics that contribute to the second intermediate audio signal, thus enhancing the input audio signal.

23 Claims, 6 Drawing Sheets

(56) References Cited

U.S. PATENT DOCUMENTS

| | | | | |
|---|---|---|---|---|
| 8,086,451 | B2 | 12/2011 | Hetherington et al. | |
| 8,130,126 | B2 | 3/2012 | Breitschadel et al. | |
| 8,150,050 | B2 | 4/2012 | Lee et al. | |
| 8,213,636 | B2 | 7/2012 | De Muynke et al. | |
| 8,676,361 | B2 * | 3/2014 | Paddock et al. | 700/94 |
| 2005/0141727 | A1 | 6/2005 | Vierthaler | |
| 2007/0058816 | A1 | 3/2007 | Ko | |
| 2007/0140511 | A1 | 6/2007 | Lin et al. | |
| 2008/0175409 | A1 | 7/2008 | Lee et al. | |
| 2009/0009251 | A1 | 1/2009 | Spielbauer | |
| 2009/0080675 | A1 | 3/2009 | Smirnov et al. | |
| 2009/0225996 | A1 | 9/2009 | Brooking | |
| 2010/0063824 | A1 * | 3/2010 | Iwata | 704/500 |
| 2010/0215192 | A1 | 8/2010 | Minnaar | |
| 2011/0038490 | A1 | 2/2011 | Yang et al. | |
| 2011/0110533 | A1 | 5/2011 | Choi et al. | |
| 2011/0142255 | A1 | 6/2011 | Tanaka | |
| 2011/0153045 | A1 | 6/2011 | Ryckman et al. | |
| 2011/0173006 | A1 * | 7/2011 | Nagel et al. | 704/500 |
| 2011/0235815 | A1 | 9/2011 | Hiselius | |
| 2012/0008798 | A1 | 1/2012 | Ong | |

FOREIGN PATENT DOCUMENTS

| | | | |
|---|---|---|---|
| EP | 0111066 | B1 | 6/1984 |
| EP | 1793370 | A2 | 6/2007 |
| EP | 1793370 | A3 | 6/2007 |
| EP | 1947903 | A1 | 7/2008 |
| EP | 1175745 | B1 | 10/2008 |
| EP | 1995720 | A2 | 11/2008 |
| EP | 2009786 | A1 | 12/2008 |
| EP | 2113913 | A1 | 4/2009 |
| EP | 1793370 | B1 | 6/2009 |
| EP | 1947903 | B1 | 6/2010 |
| EP | 2207264 | A1 | 7/2010 |
| EP | 1995720 | A3 | 5/2011 |
| EP | 2113913 | B1 | 8/2011 |
| EP | 2191660 | B1 | 8/2011 |
| WO | WO0064082 | | 10/2000 |
| WO | WO2009030235 | A1 | 3/2009 |
| WO | WO2009039897 | A1 | 4/2009 |
| WO | WO2011019339 | A1 | 2/2011 |
| WO | WO2011044064 | A1 | 4/2011 |
| WO | WO2011117028 | A1 | 9/2011 |
| WO | WO2012009670 | A2 | 1/2012 |
| WO | WO2012009670 | A3 | 1/2012 |
| WO | WO2012076044 | A1 | 6/2012 |
| WO | WO2012077104 | A1 | 6/2012 |

OTHER PUBLICATIONS

Understanding Unity Gain & Impedance Matching, ProSoundWeb, Dennis A. Bohn, Oct. 4, 2011.

* cited by examiner

METHOD AND CIRCUITRY FOR PROCESSING AUDIO SIGNALS

BACKGROUND OF THE INVENTION

1. Field of the Invention

The present invention relates to the processing of audio signals to enhance the quality and clarity and/or other characteristics of the audio signals.

2. State of the Art

In general, the concept of processing an audio signal to enhance the quality, clarity and/or other characteristics of the audio signal is known. U.S. Pat. No. 4,150,253 to Knoppel addresses this concept and describes a circuit for generating low order and high order harmonics of an input audio signal.

Another relevant patent in the prior art is U.S. Pat. No. 5,424,488 that describes a circuit for generating transient discriminate harmonics of an input audio signal.

SUMMARY OF THE INVENTION

The prior art references discussed above suffer from limitations in that the harmonics can be masked by certain higher frequency components of the audio signal (such as frequency components higher than at least 5 KHz and possibly additional higher frequency components in the range between 500 Hz and 5 KHz), thereby reducing the audibility of such harmonics. There is a significant need for an improved method and circuit to address this problem.

The present application is an audio signal processing method and circuitry that processes an input audio signal by filtering the input audio signal with a high pass filter to produce a filtered audio signal. For example, the high pass filter can have a low frequency cutoff in the range between 500 Hz and 5 KHz. In this configuration, the filtered audio signal includes frequency components of the input audio signal higher than at least 5 KHz and possibly additional higher frequency components in the range between 500 Hz and 5 KHz. The lower frequency components of the input audio signal lower than the low frequency cutoff of the high pass filter are filtered from the filtered audio signal. The filtered audio signal is input to a compressor that produces a compressor output signal. A first intermediate audio signal is produced based on the compressor output signal. The filtered audio signal is also input to a harmonics generator that produces harmonics of the filtered audio signal. A second intermediate audio signal is produced based on the harmonics of the filtered audio signal. A third intermediate signal is produced based upon the input audio signal. An output audio signal is produced by combining the first intermediate audio signal, the second intermediate audio signal and the third intermediate audio signal.

In the preferred embodiment. the compressor is configured to reduce the dynamic range of components of said filtered audio signal that contribute to the first intermediate audio signal relative to the dynamic range of the harmonics that contribute to the second intermediate audio signal. In this configuration, when the first and second intermediate audio signals are combined to produce the output audio signal (and thus the harmonics that contribute to the second intermediate audio signal are integrated with the reduced dynamic range components that contribute to the first intermediate audio signal), the harmonics become more apparent and audible in the output audio signal. This is due to the effect of the compressor in reducing the masking of the harmonics by the frequencies that pass through the high pass filter.

Moreover, the compressor preferably performs dynamic range compression on a filtered audio signal produced by a high pass filter, which causes the effect of the filtering to be more consistently audible when the reduced dynamic range components of the filtered input audio signal are integrated with the input audio signal. In an illustrative embodiment, the compressor reduces dynamic range of the filtered audio signal as compared to said input audio signal at a ratio between 5 to 1 and 15 to 1.

In the preferred embodiment, the first intermediate audio signal is produced by attenuating the compressor output signal, the second intermediate audio signal is produced by attenuating the harmonics of the filtered audio signal output by the harmonics generator, and the third intermediate audio signal is produced by the input audio signal. The attenuating of the compressor output signal as well as the attenuating the harmonics of the filtered audio signal can be controlled dynamically by user input. The attenuating of the filtered audio signal preferably causes attenuation of such filtered audio signal in a range from zero attenuation to full attenuation. The attenuating of the harmonics produced by the harmonics generator preferably causes attenuation of such harmonics in a range from 0 dB to 20 dB.

The audio signals processed by the method and circuitry of the present application can be in digital form, analog form or combination thereof.

DETAILED DESCRIPTION OF THE PREFERRED EMBODIMENTS

Figure 1:
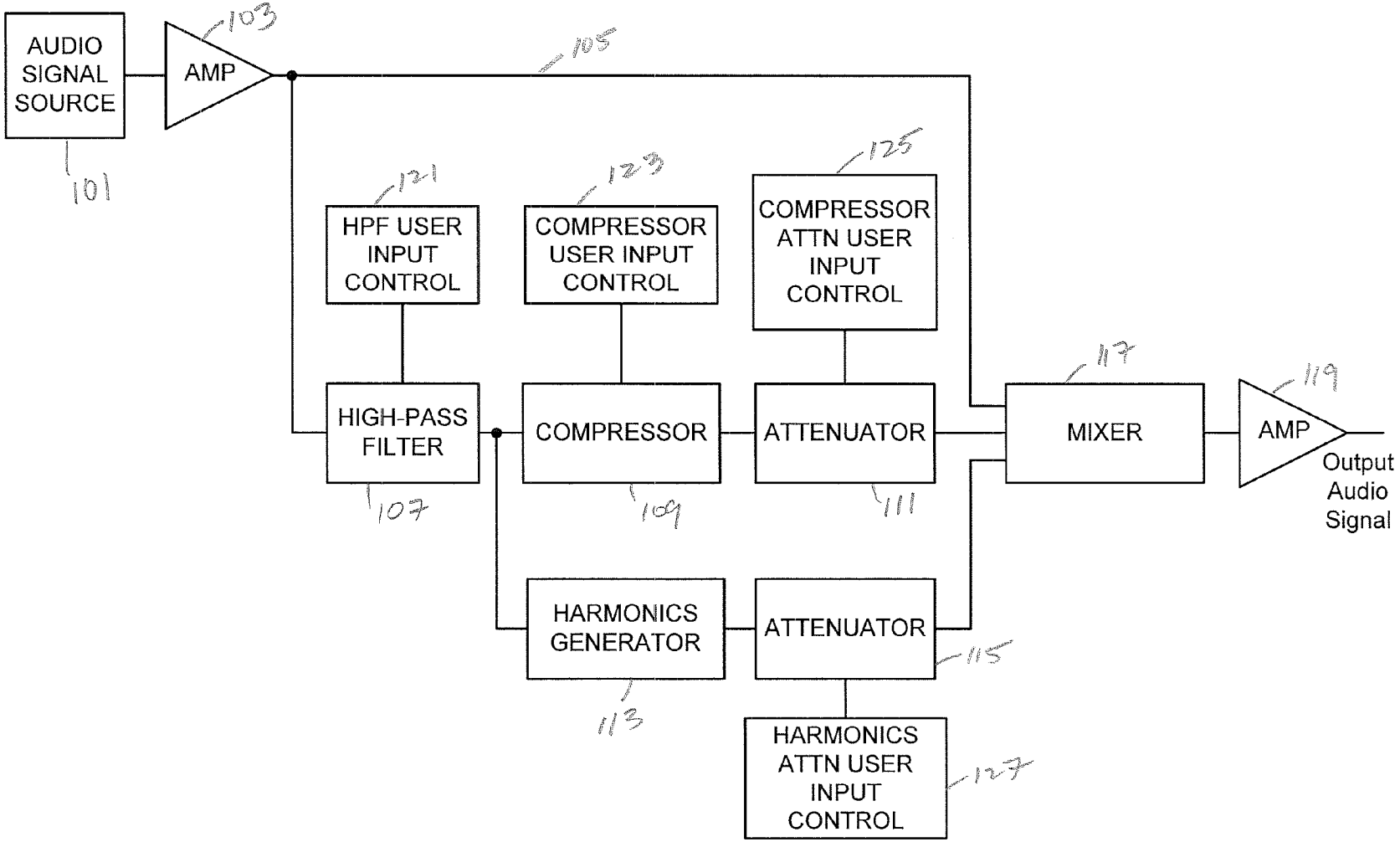
FIG. 1 is a block diagram of an audio signal processing system according to the present application.

FIG. 1 is a block diagram of an audio signal processing system according to the present application. An electrical audio signal is provided by an audio signal source 101 such as a microphone, radio tuner, CD player, audio receiver, audio amplifier, audio preamplifier, portable music player, mobile phone, computer or other data processing system that stores audio files in digital form and possibly plays the stored audio files, automobile audio head unit, satellite or cable set-top box, a television, an audio processor for audio signal transmission or storage, or other suitable audio component. The audio signal can be passed through an optional amplifier 103 and then split (or copied in the digital domain) for supply to two discrete signal processing paths. The first path 105 passes the audio signal without any enhancement. The second path includes a series of signal processing stages comprising a high-pass filter 107, a compressor 109 and an attenuator 111. The signal output from the high-pass filter 107 is split (or copied in the digital domain) for supply to the compressor 109 and to a third signal processing path that includes a series of signal processing stages comprising harmonics generator 113 and a second attenuator 115. The outputs of the three signal processing paths (i.e., the outputs of the attenuators 111, 115) are supplied to a mixer 117 for recombination. The relative gain of the signal output from the three signal processing paths (i.e., the output of the attenuators 111, 115 and the input signal) in the recombined signal can be adjusted by the mixer 117. The resultant recombined signal produced by the mixer 117 can be passed through an amplifier 119 for output as an output audio signal as shown. The output audio signal can be fed to an output transducer (such as an audio speaker) or to another suitable audio device.

The compressor 109 of FIG. 1 is an amplifier that outputs one decibel of volume increase per X number of decibels of increase present at its input that exceeds a threshold Y. The parameters X and Y can be fixed parameters, dynamic parameters or user-controlled parameters. A 10:1 compressor would output 1 dB of volume increase for every 10 dB of volume increase present at its input that exceeds the threshold. Below the threshold, 1 dB in of volume increase equals 1 dB out of volume increase. The compressor 109 reduces the volume of loud sounds or amplifies quiet sounds by narrowing or "compressing" the dynamic range of the audio signal. Compression is often used to make music sound louder without increasing its peak amplitude. By compressing the peak (or loudest) signals, it becomes possible to increase the overall gain (or volume) of a signal without exceeding the dynamic limits of a reproduction device or medium. The net effect, when compression is applied along with a gain boost, is that relatively quiet sounds become louder, while louder sounds remain unchanged or are reduced in volume.

The harmonics generator 113 of FIG. 1 generates harmonics of the components of the input audio signal that are passed by the high pass filter. A harmonic is a signal whose frequency is an integral (whole-number) multiple of the frequency of some reference signal, in this case the components of the input audio signal that are passed by the high pass filter. For example, if f represents the main (or fundamental) frequency of the components of the input audio signal that are passed by the high pass filter, then the frequency f is the frequency at which most of the energy is contained, or at which the signal is defined to occur. For a signal whose fundamental frequency is f, the second harmonic has a frequency 2f, the third harmonic has a frequency of 3f, and so on. Signals occurring at frequencies of 2f, 4f, 6f, etc. are called even harmonics; and the signals at frequencies of 3f, 5f, 7f, etc. are called odd harmonics. The frequency f is typically expressed in hertz. A signal can, in theory, have infinitely many harmonics. The introduction of harmonics can significantly enhance the sound quality of the audio signal.

The amplifier 103, if present, can provide for impedance matching with respect to the audio signal source 101 and/or provide for common mode rejection. It can also provide for amplification of the input audio signal to a level that is optimal for the signal processing functions of the system as described herein. The amplifier 103 preferably operates over the full audio bandwidth, which is generally defined as encompassing frequencies between 20 Hz and 20,000 Hz.

The mixer 117 and amplifier 119 also preferably operate over the full audio bandwidth with unity gain output of the amplifier 119 as compared to the audio signal supplied by the audio signal source 101. The amplifier 119 can provide for impedance matching for the output audio signal. It can also provide for amplification of the output audio signal to a level that compensates for any gain changes caused by the signal processing of the system.

The high pass filter 107 can have a low frequency cut off in the range from 500 Hz to 5,000 Hz. The low frequency cut off of the high pass filter 107 can be dictated by user input via HPF user input control 121. In this configuration, the filtered audio signal includes frequency components of the input audio signal higher than at least 5 KHz and possibly additional higher frequency components in the range between 500 Hz and 5 KHz. The lower frequency components of the input audio signal lower than the low frequency cutoff of the high pass filter are filtered from the filtered audio signal that is passed by the high pass filter 107.

The compressor 109 can provide for a fixed or dynamic compression ratio or other fixed or dynamic parameters (such as attack time or release time parameters or compression density), which can be dictated by user input via compressor user input control 123. The attenuator 111 can provide for an adjustable attenuation factor between full attenuation and zero attenuation, which can be dictated by user input via user input control 125. The attenuator 127 for the third signal processing path can provide for an adjustable attenuation factor preferably between 20 dB attenuation and zero attenuation, which can be dictated by user input via user input controls 127.

The audio circuit of FIG. 1 provides for audio signal processing that involves both dynamic level compression of components of the input audio signal and the generation of harmonics of components of the input audio signal together with functionality to integrate the enhancements of both functions as part of an output audio signal. In the preferred embodiment, the compressor is configured to reduce the dynamic range of filtered components of the input audio signal relative to the dynamic range of the harmonics produced by the harmonic generator. In this configuration, when the harmonics are integrated with the reduced dynamic range filtered components of the input audio signal as part of an output audio signal, the harmonics become more apparent and audible in the output audio signal. Moreover, the compressor preferably performs dynamic range compression on filtered audio signal produced by a high pass filter, which causes the effect of the low-frequency filtering to be more consistently audible when the reduced dynamic range components of the filtered input audio signal are integrated with the input audio signal.

Figure 2:
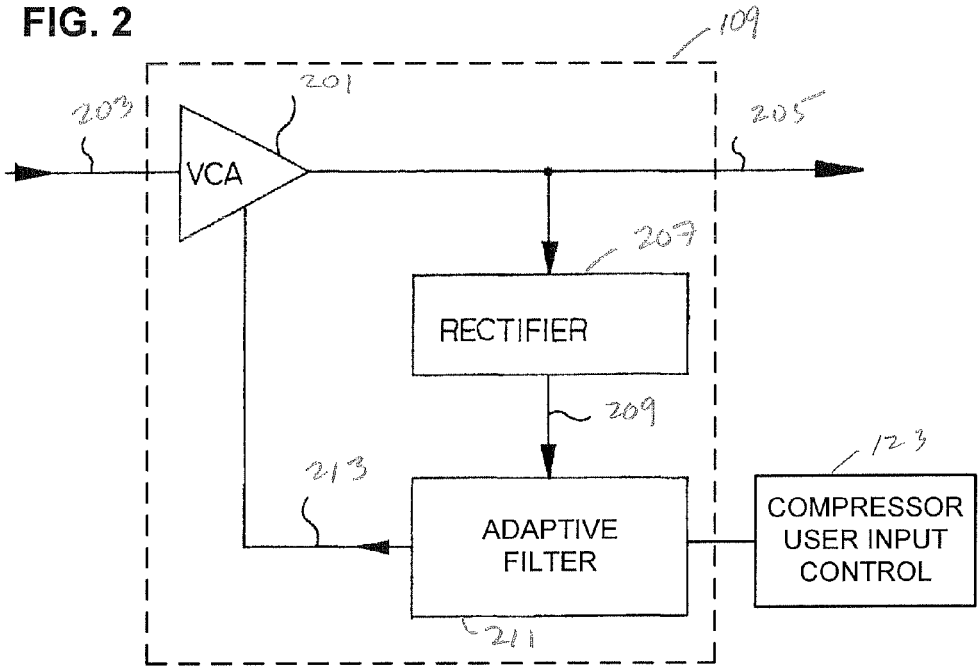
FIG. 2 is a block diagram of an illustrative embodiment of the compressor circuitry of FIG. 1.

FIG. 2 is a high level block diagram of an illustrative embodiment of the compressor 109 of FIG. 1. The compressor 109 includes a voltage-controlled amplifier 201 electrically coupled between an input signal path 203 and an output signal path 205, a rectifier 207 electrically coupled to the output signal path 205 for rectifying the output signal and producing a rectified output signal 209, and an adaptive filter 211 that processes the rectified output signal 209 to generate a feedback signal 213 for controlling operation of the voltage-controlled amplifier 201. The adaptive filter 211 operates with a multiplicity of interactive layered time constants such that feedback control signal 213 is instantaneously and continuously dependent upon both the average and the transient peak value of the rectified output signal 209. Certain characteristics of the adaptive filter 211 can affect the operating parameters of the compressor 109 (such as compression ratio, attack time or release time parameters or compression density) and can be dictated by user input via compressor user input control 123 for dynamically updating the operating parameters of the compressor 109.

Figure 3:
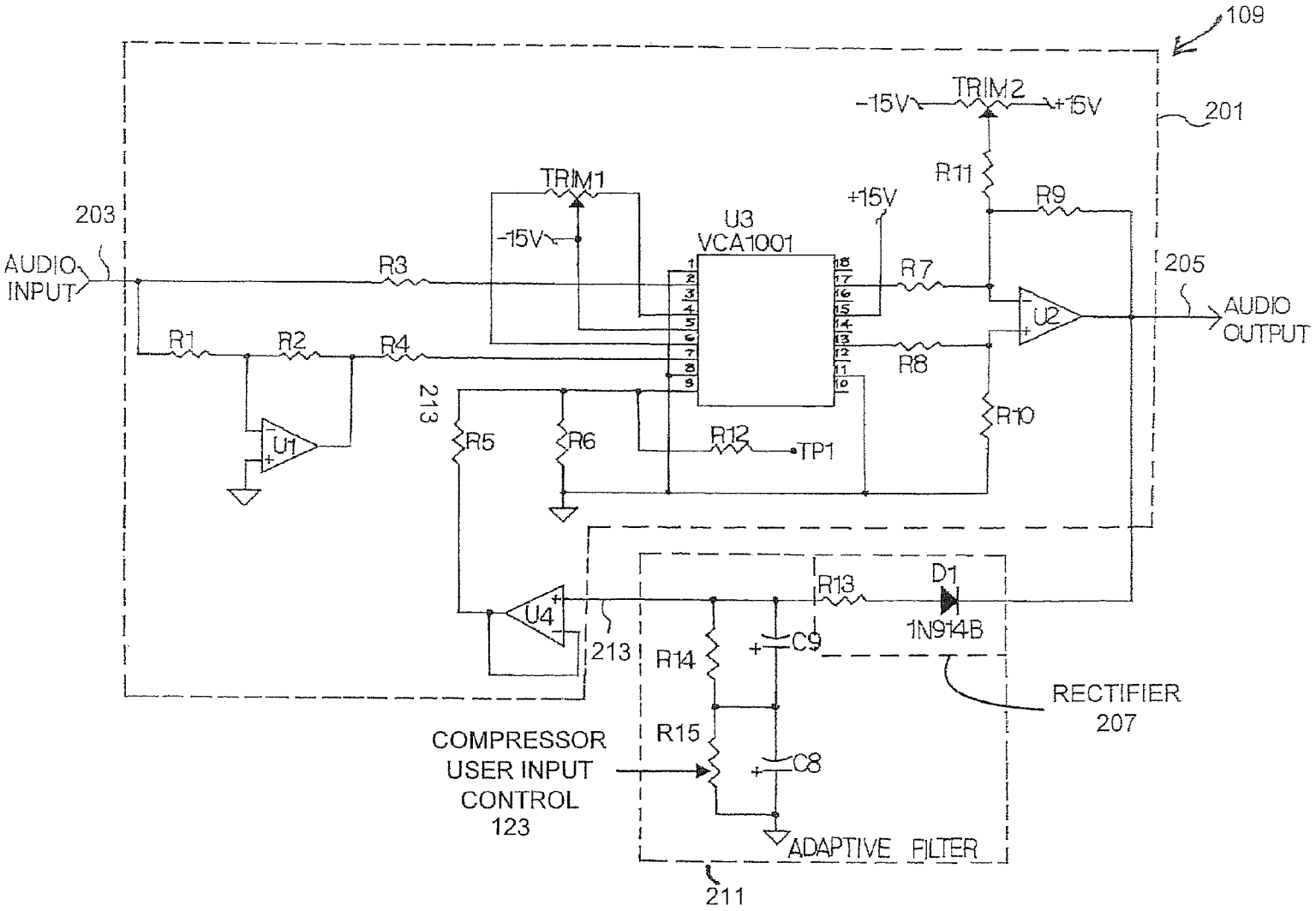
FIG. 3 is a schematic of an analog circuit implementation that embodies the compressor circuitry of FIG. 2.

FIG. 3 is a schematic diagram showing an exemplary analog circuit implementation of the compressor of FIG. 2.

The voltage-controlled amplifier 201 of FIG. 2 is implemented in FIG. 3 by the combination of U1 through U4, and resistor R1 through resistor R12. These components form a practical voltage-controlled amplifier circuit with an audio input, an audio output, and a control input. The components U1, U2, and U4 can be implemented with any suitable type of operational amplifier such as the LF347 quad bifet op amp sold commercially by Texas Instruments, Inc. of Dallas, Tex. The component U3 is a voltage-controlled attenuator such as the VCA1001 chip available from Aphex, LLC of Burbank, Calif. The component U1 acts as a phase invertor for the input signal. Pins 2 and 7 of the voltage-controlled attenuator U3 receives as inputs the audio input signal as well as the phase-inverted input signal (180 degrees out of phase) produced the component U1. The voltage-controlled attenuator U3 attenuates the audio input signal as well as the phase-inverted input signal input on pins 2 and 7 under control of feedback signal supplied to pin 9 of the voltage-controlled attenuator U3. The attenuated signals are output on pins 17 and 13 of the voltage-controlled attenuator U3 and supplied to a differential amplifier comprised of U2, and resistor R7 through resistor R11, which rejects the common mode output of U3 and renders the final VCA audio output signal 205. The output of U2 feeds the diode D1 which acts as a half wave rectifier. Negative half waves conducted through diode D1 generate the charging current of the adaptive filter, as described below in great detail. The negative polarity of the feedback control signal output from the adaptive filter as described below is buffered by the op amp U4 (which is in a follower configuration) and supplied to pin 9 of the voltage-controlled attenuator U3 to control the attenuation function of the voltage-controlled attenuator U3. High amplitude transient output signals output from pins 17 and 13 of the voltage-controlled attenuator U3 are filtered by the adaptive filter to cause greater attenuation by the voltage-controlled attenuator U3. This produces an adaptive amplitude regulating effect due to the nature of the adaptive filter as described below.

Note that the resistors labeled Trims 1 and 2 can be adjusted to obtain the lowest control feed through with an average offset of zero volts DC at the output of U2 as described in U.S. Pat. No. 5,483,600.

The rectifier 207 of FIG. 2 is implemented in FIG. 3 by diode D1 and resistor R13, which serves as a half-wave rectifier. By way of example only, resistor R13 can be 20 k-ohms. The diode D1 also functions as a reverse current blocker for the adaptive filter such that reverse current cannot flow from the adaptive filter to the audio output node.

The adaptable filter 211 of FIG. 2 is implemented in FIG. 3 by a resistor-capacitor ("RC") network including capacitors C9 and C8 that are connected in series between the rectified output signal (produced at the output of the rectifier output of resistor R13) and ground together with resistors R14 and R15 that are also connected in series between the rectified output signal and ground. The intermediate node of the series-coupled capacitors C8 and C9 is coupled to the intermediate node of the series-coupled resistors R14 and R15. The resistor R15 is a variable resistor (such as a potentiometer) whose resistance is controlled by compressor user input control 123, which can be realized by a knob or other suitable user input mechanism. By way of example only, the capacitor C9 is 1 uF and the capacitor C8 is 4.7 uF, while the resistor R14 is 20 k-ohms and the variable resistor R15 ranges from 100 k-ohms to 1 M-ohm.

It can be seen that there are a multiple of time constants within the RC network of FIG. 3. The rectified current from resistor R13 can be called the "charging current" since this current charges up the capacitors C9 and C8. The discharge path of capacitors C9 and C8 includes only resistors R14 and R15. The charging and discharging of the capacitors C9 and C8 charge dictate the function of the adaptive filter. Assuming a sufficiently large rectified audio signal is applied to diode D1, a current will flow through resistor R14 and capacitor C9. Several paths of current are possible. The resistors R14 and R15 will carry a current to ground directly, and capacitor C9 will pass current through resistor R15 and capacitor C8. Capacitor C8 receives a current through capacitor C9 and resistor R14. As the capacitors C9 and C8 build a charge, the current divides in different proportions among these paths. This is due to asymptotic charging curve of a capacitor.

More specifically, capacitor C8 acts as a relatively slow charging filter, while capacitor C9 acts relatively fast. Since they are stacked in a series, the net filter output voltage is the sum of the voltages on capacitors C9 and C8. Capacitor C8 charges up from current brought down through the branch resistors R13 and R14, and also through the branch of resistor R13 and capacitor C9. Capacitor C8 charges initially faster through the branch of resistor R13 and capacitor C9 because capacitor C9 is accepting maximum charge and dumps a relatively large current through capacitor C8. This rapidly adds a partial charge to capacitor C8, but the charging of capacitor C8 by the current through capacitor C9 is short lived since capacitor C9 rapidly charges to nearly the input voltage and its charging current then stops. If the input voltage is now removed, the output voltage of the adaptable filter is dictated by the voltage developed across capacitor C9. If the input voltage remains longer, capacitor C8 will sustain further charging through the branch of resistors R13 and R14. This will be much slower than the initial charge of capacitor C8 by the charging current of capacitor C9. As the voltage charge of capacitor C8 rises, the total voltage across capacitors C8 and C9 will nearly equal the input voltage. This does not bring a halt to charging currents, because capacitor C9 will begin to discharge through resistor R14 as the charge of capacitor C9 rises. There will be a transition period wherein the charge of capacitor C9 relatively slowly rises and the charge of capacitor C8 falls. Equilibrium will be reached when the voltage charges on capacitors C9 and C8 equal the voltage division of the ladder of resistors R13, R14 and R15. Since resistor R15 may have a variable resistance, the charge ratio of capacitors C9 and C8 may also be variable.

When the input voltage is removed, capacitors C9 and C8 begin to discharge. The discharge paths of capacitors C9 and C8 tend to circulate through their parallel resistances of resistors R14 and R15, respectively, since the path up through resistor R13 is blocked by the 10 reverse impedance of diode D1. The time constant of R14-C9 is much faster than that of R15-C8, so capacitor C9 can discharge relatively fast while capacitor C8 discharges more slowly.

In the preferred embodiment, the adaptive filter is configured to react to different types of input signals as set forth in U.S. Pat. No. 5,483,600.

Specifically, if the input signal is a short transient, capacitor C9 will charge and discharge relatively fast with little charge going to capacitor C8. The output of the adaptable filter will contain a fast rise and fall.

If the input is a repeating series of short transients, capacitor C9 will first charge up then gradually charge and discharge at a proportionately lesser average voltage as capacitor C8 progressively builds up its charge. The output of the adaptive filter will contain a fast attack but the output ripple will slowly diminish. Finally, the output will contain a relatively slow fall time.

If the input contains a fairly steady signal with a fast attack and decay, capacitor C9 at first attains a high charge, but subsequently its charge gives way to the charge which builds up on capacitor C8. The output of the adaptive filter contains a fast rise followed by a slight fall to a steady value followed by a slow fall.

If the input is a slow rising and relatively steady signal, then capacitor C9 does not attain much charge because capacitor C8 can attain a charge fast enough through 40 the branch of resistor R13 and resistor R14 to track the input rate of rise. The output of the adaptable filter is basically that of the voltage on capacitor C8 alone with relatively little contribution from capacitor C9.

As noted above, the value of resistor R15 dictates the relative weight of charge on capacitor C9 and capacitor C8 by changing of the point of charge equilibrium. Specifically, as resistor R15 becomes smaller, the point of charge equilibrium weighs the charge of capacitor C9 heavier and the output signal of the filter output contains a higher portion of the capacitor C9 charge for the conditions of more sustained and less transient input signals.

It can be generalized that the faster time constants related to capacitor C9 more closely follow the peaks of the input signal and the slower time constants related to capacitor C8 more closely follow the average of the input signal. Therefore, the output of the adaptable filter contains both average and peak following components which are interactive.

Moreover, it can be generalized that the output of the adaptive filter of FIG. 3 acts mainly like a peak following filter for a single transient input. The adaptive filter transforms from peak following to average following for repetitive transient inputs. For a non-transient input, the adaptive filter transforms from peak to average following if the input has a fast attack, but remains mainly an average follower if the non-transient input has a slower attack. In this manner, the adaptive filter of FIG. 3 adapts to the transient nature of the input signal, and to the input signal's average characteristics. The benefit of this action is in allowing the adaptive filter of FIG. 3 to react in the manner which is optimum for any audio signal. This statement is based upon the supposition that a transient signal sounds better if compressed with fast time constants, allowing the compressor to effectively reduce the transient amplitude but not sustain the gain reduction long enough for the listener to notice a level reduction of the average sound level surrounding the transient peak. The transient peaks which repeat at sufficient frequency should at first be compressed with a fast action but if their repeating pattern is sustained long enough, a slower averaging gain reduction would be desirable to prevent the listener from perceiving that the level of the average sounds surrounding the transients are modulated by the fast peak flowing gain reduction. If the sounds are mainly non transient, the ripple of the output signal of the adaptive filter should be minimized to reduce waveform distortion of the audio output. This requires generally slower filter averaging. It has been shown that the responses of the adaptive filter of FIG. 3 convolve to meet this various conditions.

Resistor R15 can have a variable resistance which controls the "release time constant" of the adaptive filter of FIG. 3 because it has the effect of slowing down or speeding up the discharge of the stored voltage of the adaptive filter. A faster release time constant, which results from a reduction in the value of resistor R15, causes the compressor to release faster, thus maintaining a higher average output level. Another consequence of reducing the value of resistor R15 is that of changing the relative charge equilibrium of capacitor C9 and capacitor C8. Specifically, when resistor R15 is smaller, the branch of resistor R13, resistor R14 and resistor R15 divides differently and a smaller proportion of the input voltage is developed across the capacitor C8. This makes capacitor C9 contain a larger relative charge and capacitor C8 a smaller relative charge when a sustained non-transient input signal. Thus, not only is the average compression release made faster, but the transformation of peak following to average following is less complete. This leaves peak following more present in the VCA control, and the density of compression consequently increases. The density of compression is the extent to which the amplitudes of audio signal peaks are made uniform at the expense of dynamic range. Such an increase in density of compression is a useful effect because the usual reason for speeding up the release time of a compressor is to gain greater compression density. Typically, however, the increased density so derived comes at the cost of a much more intense gain modulation effect causing transient peaks to audibly modulate the level of smaller signals. The compressor of FIG. 3 reduces this effect considerably by the combination of time constants and the tendency to convolve between peak and average following.

It is also contemplated that resistor R13 can have a variable resistance which is dictated by user input controls to control the "attack time constant" of the adaptive filter of FIG. 3 because the resistor R13 has the effect of speeding up or slowing down the charging of the stored voltage of the adaptive filter. Specifically, the attack time constant is determined by the values of resistor R13 and the capacitors C8 and C9. A faster attack time constant, which results from a reduction in the value of resistor R13, causes the compressor to attack faster toward peak following. A slower attack time constant, which results from an increase in the value of resistor R13, causes the compressor to attack slower toward average following.

The compression ratio of the adaptive filter of FIG. 3 is dependent on the gain of the feedback loop through op-amp U4 and R5 to pin 9 of the voltage-controlled attenuator U3. It is contemplated that such gain (and the resulting compression ratio) can be varied according to user input controls if desired.

It is noted that the analog circuit implementation of FIG. 3 shows a specific polarity for diode D1. This polarity is shown for illustration only. It should be obvious that the polarity of the diode D1 can be reversed and the circuit will function identically except the polarity of the input and output voltages would be reversed. If capacitors C9 and C8 are implemented as polarized capacitor types, their polarization in the circuit can be properly arranged.

Figure 4:
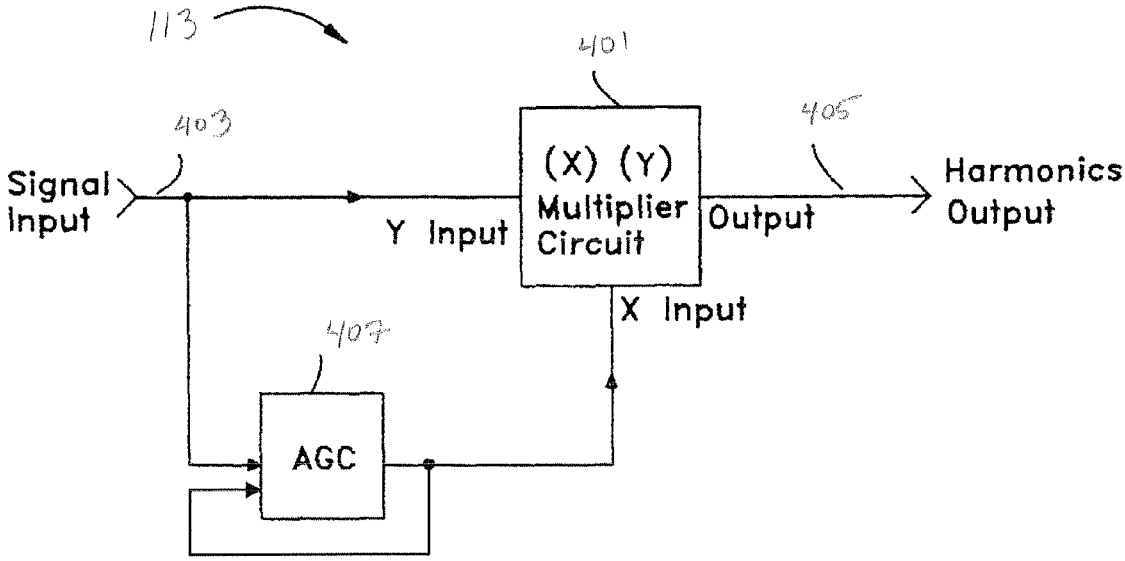
FIG. 4 is a block diagram of an illustrative embodiment of the harmonics generator circuitry of FIG. 1.

FIG. 4 is a high level block diagram of an embodiment of the harmonics generator 113 of FIG. 1. The harmonics generator 113 of FIG. 4 includes a multiplier 401 electrically coupled between an input signal path 403 and an output signal path 405 and an automatic gain control (AGC) function 407. The multiplier 401 can be a linear multiplier having a transfer function of (XY)/K where X is the signal at an X input, and Y is the signal at a Y input, and K is a constant. The AGC function 407 generates the X-input signal that modulates the multiplier circuit 401 in accordance with the input signal (Y input) and the output X signal supplied to the multiplier circuit 401. The parameters of the AGC function 407, such as a specific compression ratio as well as attack and release times, can be determined for best audio effect in a particular application. Nonetheless, the attack time is required to be of a finite value. One or more parameters of the AGC function 407 can also be dictated by user input controls for user control of the audio effect, if desired. The AGC function 407 and the multiplier 401 cooperate to generate harmonics of components of the input signal 403 at the output 405.

Figure 5:
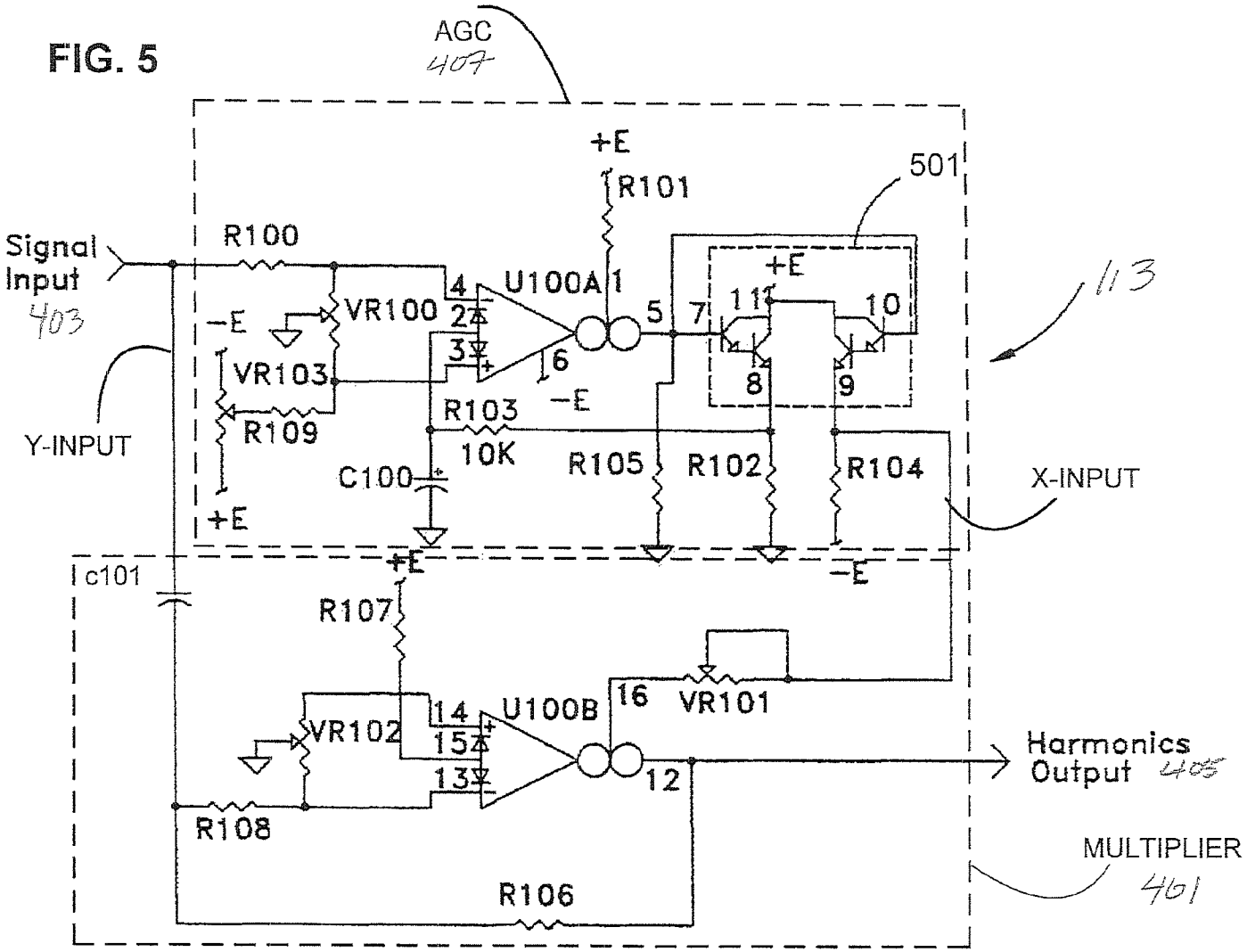
FIG. 5 is a schematic diagram of an analog circuit implementation that embodies the harmonics generator circuitry of FIG. 4.

FIG. 5 is a schematic diagram showing an exemplary analog circuit implementation of the harmonics generator 113 of FIG. 4. The harmonics generator 113 includes two functional circuits (multiplier circuit 401 and an AGC circuit 407) based on an LM13700 dual operational transconductance amplifier (OTA) chip sold commercially by Texas Instruments, Inc. of Dallas, Tex. The LM13700 includes two OTAs (labeled U100A and U100B in FIG. 5) as well as two Darlington transistor pairs. The multiplier circuit 401 is realized by the OTA U100B of the LM13700 integrated circuit. The AGC function 407 is realized by the OTA U100A and the two Darlington transistor pairs of the LM13700 integrated circuit. Note that the pin numbers 1 through 16 of FIG. 5 are the pin numbers of the LM13700 integrated circuit.

The multiplier circuit 401 also includes capacitor C101, resistors R106, R107 and R108, and variable resistors VR101 and VR102. By way of example only, capacitor C101 may be 22F, resistors R106 and R107 may be 10 k-ohms, resistor R108 may be 5 k-ohms, variable resistor VR101 may be 50 k-ohms, and variable resistor VR102 may be 1 k-ohm.

The AGC circuit 407 also includes capacitor C100, resistors R100, R101, R102, R103, R104, R105 and R109, and variable resistors VR100 and VR103. The dotted block 501 are the two Darlington transistor pairs of the LM13700 integrated circuit, which is used to buffer the output of the OTA 100A. By way of example only, capacitor C100 may be 4.7 uF, resistor R100 may be 250 k-ohm, resistor R101 may be 30 k-ohm, resistors R102, R103 and R104 may be 10 k-ohm, resistor R105 may be 100 k-ohm, resistor R109 may be 10 M-ohm, variable resistor VR100 may be 25 k-ohm, and variable resistor VR103 may be 50 k-ohm. The variable resistors VR103 and R109 provide for nulling of the control feed through of the OTA 100A. Capacitor C101 isolates the DC input offset voltage of the multiplier circuit. In addition, positive voltage +E and negative voltage −E are provided to the circuit. By way of example only, the positive voltage +E may be 15 V and the negative voltage −E may be −15 V.

The input signal 403 is split and supplied to the AGC circuit 407 via resistor R100 and to the multiplier OTA U100B as the Y-input via DC coupling capacitor C101 and resistor R108. The AGC OTA U100A is configured by the resistors VR100, VR103, R109, C100, R103, and R102 to generate an X-input signal that modulates the multiplier circuit 401 in accordance with the input signal 403 and the output X-input signal. Feedback control of the AGC OTA U100A is provided by the signal path from pin 8 of the Darlington pair transistors (which produces a signal corresponding to the buffered output X-input signal on pin 9) to pin 2 of the AGC OTA U100A via resistor-capacitor network R102, R103, and C100. The parameters for the AGC circuit 407, such as the limiter threshold, the attack and/or release times as well as the compression ratio of the AGC can be determined for the best effect in a particular application. One or more of the parameters of the AGC circuit 407 can also be dictated by user input controls for user control of the audio effect, if desired.

In one embodiment, the harmonics generator 113 of FIG. 5 can be configured as a transient discriminator harmonics generator that generates a relatively high level of harmonics at the start of the amplitude envelope of the input signal and then reduces the level of harmonics generated during an intermediate portion of the amplitude envelope of the input signal and then generates a relatively low level of harmonics at the terminal part of the amplitude envelope of the input signal. The relative timing of the leading edge of the intermediate portion of the amplitude envelope where the level of harmonics is reduced is dictated by the attack time parameter of the AGC circuit 407 of FIG. 5. The attack time parameter of the AGC circuit 407 represents how quickly the gain of the AGC circuit 407 is adjusted when the input signal magnitude exceeds a threshold limit. The attack time parameter of the AGC circuit 407 is dictated by the capacitor C101, the resistor R108 and the variable resistance VR102. User input controls can control the variable resistance VR102 in order to adjust the attack time and the corresponding relative timing of the leading edge of the intermediate portion of the amplitude envelope where the level of harmonics is reduced. The duration of the intermediate portion of such amplitude envelope is fixed by the design of capacitor C101 and the resistors R108 and R106 of FIG. 5. It is also contemplated that one or both values for resistors R108 and R106 (and the resulting duration of the intermediate portion of such amplitude envelope) can be varied according to user input controls if desired. The compression ratio of the AGC circuit 407 is dependent on the gain of the feedback loop through resistors R106 and R108 to pin 13 of the multiplier OTA U100B. It is contemplated that such gain (and the resulting compression ratio) can be varied according to user input controls if desired.

The X-input signal, which is generated at the output of the two Darlington transistor pairs at pin 9 of the LM13700 integrated circuit, is supplied as a current input to pin 16 of the multiplier OTA U100B by the input resistance of variable resistor VR101. The Y input signal is supplied to the input pin 13 of the multiplier OTA U100B by coupling capacitor C101 and resistor R108. The multiplier OTA U100B is configured by variable resistor VR102 and R107. The multiplier OTA U100B generates the harmonics output signal 405 at pin 12 of the multiplier OTA U100B. It is noted that pin 12 is a high impedance output and must not be significantly loaded by any external impedances for correct operation.

In alternate embodiments, the multiplier circuit 401 can be realized by any variety of voltage-controlled amplifiers (VCAs) with a signal input, signal output and gain control input. If a VCA is utilized, it can be defined as an XY multiplier if the signal input is equated to the "Y" channel input and the gain control input is equated to the "X" channel input. The only difference between a linear multiplier and a VCA used as a multiplier is that the transfer function of a VCA "X" input is usually exponential, so that the output transfer function would be generally (Y)(exp X)/K. Nevertheless, the output of the linear multiplier or the VCA used as a multiplier will contain harmonics of the input signal, and the circuit shown in FIG. 4 remains valid.

Figure 6:
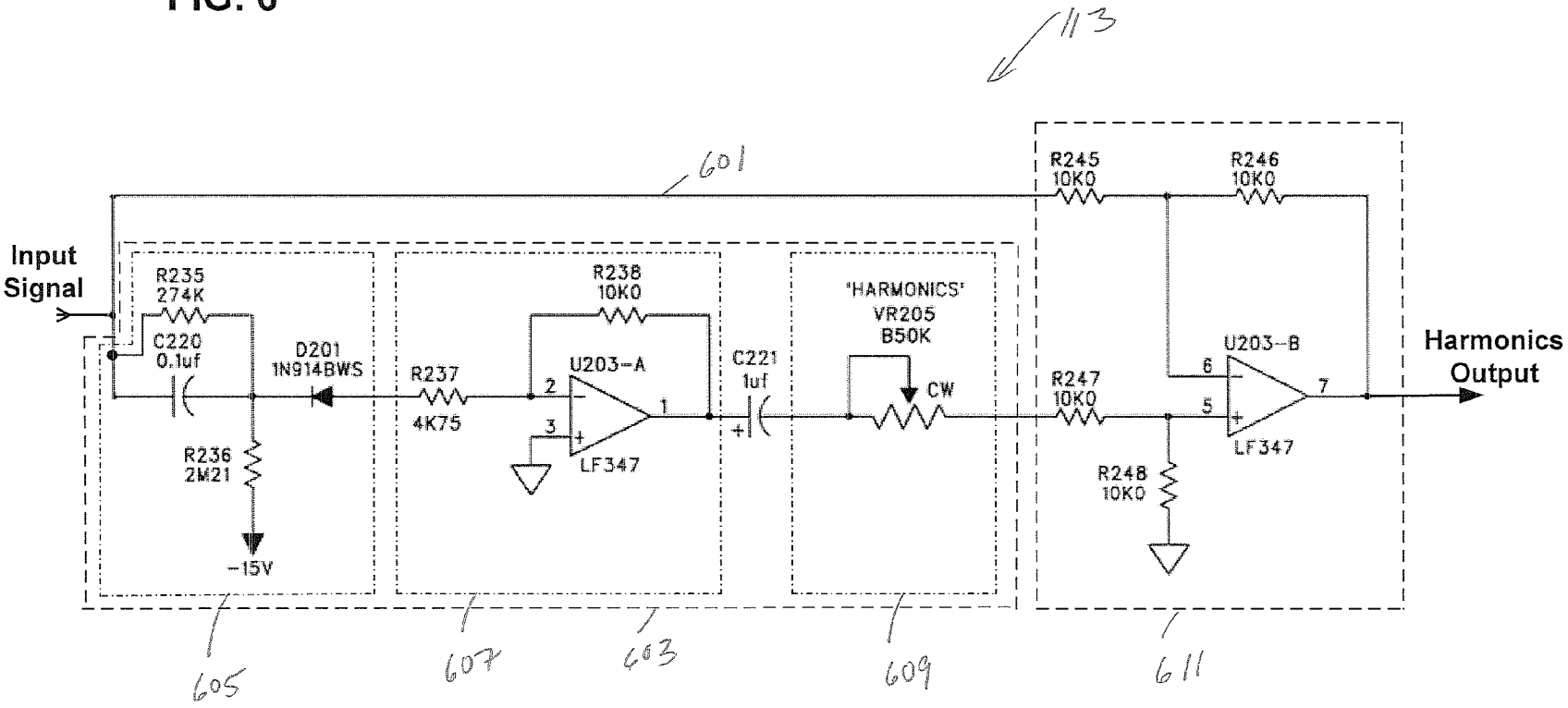
FIG. 6 is a schematic diagram of another analog circuit implementation of the harmonics generator circuitry of FIG. 1.

FIG. 6 is a schematic diagram showing another exemplary analog circuit implementation of the harmonics generator 113 of FIG. 1. The harmonics generator 113 of FIG. 6 splits the input signal for supply to two discrete signal processing paths. The first signal processes path 601 passes the input signal without any enhancement. The second signal processing path 603 includes a series of audio signal processing stages 605, 607, 609. Stage 605 includes an RC network (resistor R235, capacitor C220, resistor R236) and diode D210 that cooperate to generate negative voltage transient component signal based upon the input signal. The RC network generates a transient component waveform based upon the input signal. The diode D210 is configured for half wave rectification where negative voltages of the transient component waveform generated by the RC network pass through the diode D210. In this manner, diode D210 produces a negative voltage transient component signal that is based upon the input signal. Stage 607 is an inverting amplifier stage that produces a positive voltage transient signal of inverse polarity with respect to the negative voltage signal produced by the diode D210. Stage 607 is realized by the operational amplifier U203-A and resistors R237 and R238. The gain of the inverting amplifier stage 607 is proportional to (−R238/R37), which is set to (−10K/4K) or −2.5 as shown. Stage 609 is a gain control stage that employs variable resistor VR205 to provide an adjustable voltage gain to the positive voltage transient component signal output from stage 607. The output of stage 609 is the output of the signal path 603. In this manner, the signal path 603 outputs a positive voltage transient signal that is derived from the input signal. The input signal supplied by signal path 601 as well as the positive voltage transient component signal generated by the signal path 603 are supplied to a difference amplifier stage 611 that generates an output signal that represents the difference between the positive voltage transient component signal generated by the signal path 603 and the input signal supplied by signal path 602. Stage 611 is realized by an operational amplifier U203-B and resistors R245, R246, R247, and R248. The input signal supplied by signal path 602 is coupled to the inverting input of the operational amplifier U203-B via the resistor network R245, R246, and the positive voltage transient component signal generated by the signal path 603 is supplied to the non-inverting input of the of the operational amplifier U203-B via the resistor network R247, R248. The output signal of the difference amplifier stage 611 has asymmetry that represents harmonics of the input signal supplied by signal path 602 and thus is labeled harmonics output in FIG. 6. One or more parameters of the signal processing path 603 (such as the gain afforded by the variable resistor VR205 of the gain control stage 609) and/or parameters of the mixing stage 611 can be dictated by user input controls for user control of the audio effect, if desired.

A variety of modifications can be made to the circuit of FIG. 6. For example, stage 607 can be realized by a non-inverting amplifier stage that generates a negative voltage transient component signal based on the input signal. In this case, stage 611 can be realized by a summing amplifier stage that generates an output signal that represents the difference between the negative voltage transient component signal generated by the signal path 603 and the input signal supplied by signal path 602.

Figure 7:
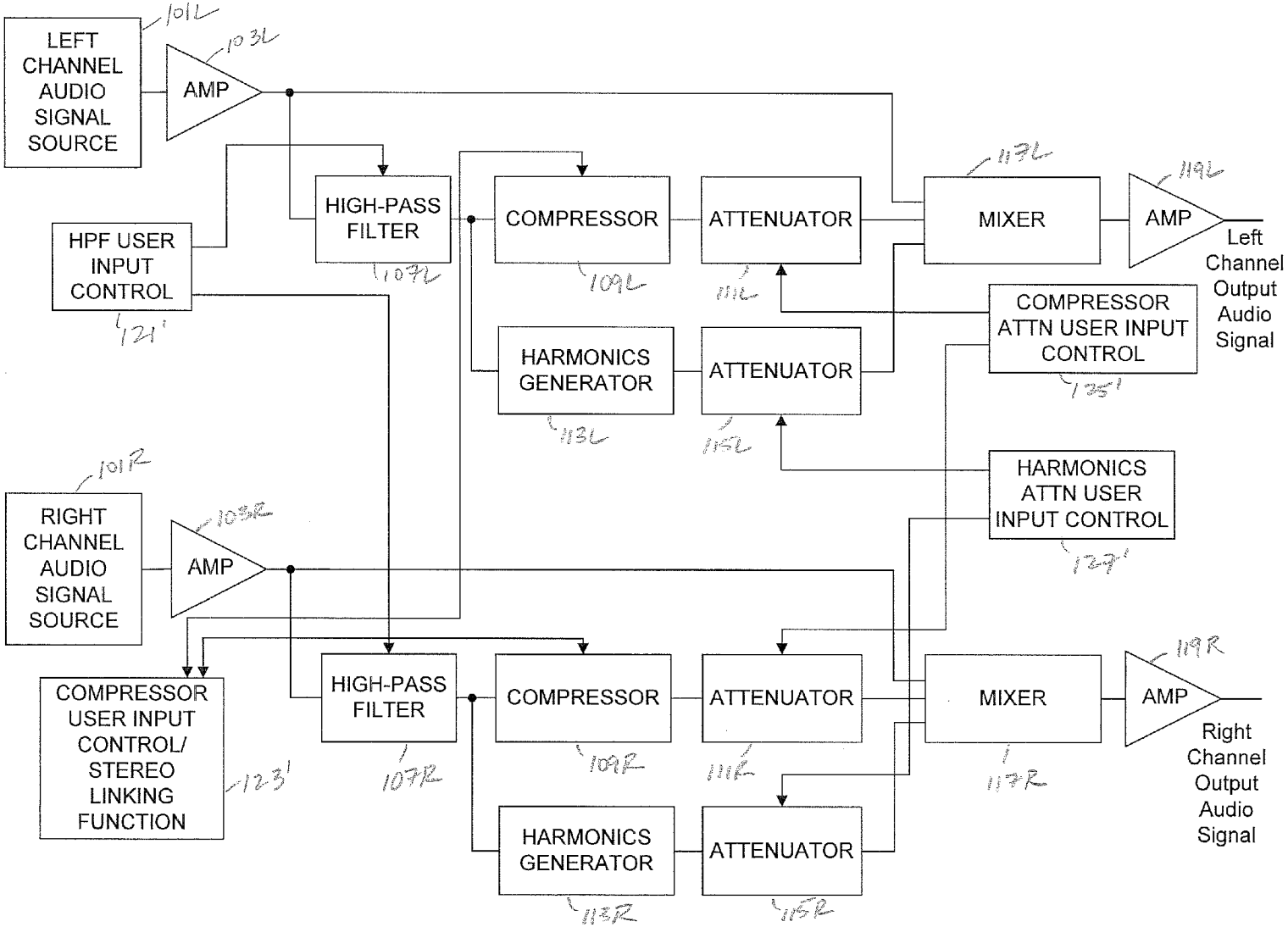
FIG. 7 is a block diagram of a stereo audio signal processing system according to the present application.

FIG. 7 is a block diagram of a stereo audio signal processing system based upon the circuitry of FIG. 1 replicated for processing left and right audio signal channels, respectively. The system can include a user input control 121' that dictates operation of the respective high pass filter circuits 107L, 107R that process the left and right audio signal channels in a manner similar that described above for the user input control 121. The system can also include a user input control 125' that dictates operation of the respective attenuators 111L, 111R in a manner similar that described above for the user input control 125. The system can also include a user input control 127' that dictates operation of the respective attenuators 115L, 115R in a manner similar that described above for the user input control 127. The system can also include compressor user input control 123' that dictates operation of the respective compressors 109L, 109R in a manner similar that described above for the user input control 123. Note that the compressor user input control 123' employs a stereo linking function that mixes or otherwise processes the feedback control signals generated by the adaptive filter of the left and right channel compressors 109L, 109R so that each channel is compressed to the same extent.

It is emphasized that the circuits described herein are not intended as a limitation to the embodiments of the present invention. There are many more circuits that can be adapted to follow the teaching of the present application. Moreover, it is contemplated that the circuits (or parts therein) can be implemented by a programmed data processing system (such as a digital signal processor) that operates on audio signals in the digital domain. In this case, an analog audio input signal is converted into a digital audio signal by sample and hold circuitry and suitable analog-to-digital conversion circuitry well known in the electronic arts. In order to output an analog audio signal, the digital audio signal is converted into an analog signal by suitable digital-to-analog conversion circuitry well known in the electronic arts.

Moreover, it is contemplated that the circuit described herein can be integrated as part of an audio component such as a microphone, radio tuner, CD player, audio receiver, audio amplifier, portable music player, mobile phone, computer or other data processing system that stores audio files in digital form and possibly plays the stored audio files, automobile audio head unit, satellite or cable set-top box, a television, an audio processor for audio signal transmission or storage, or other suitable audio components.

Moreover, it is contemplated that the audio signal processing functions can be embodied in software (such as an application or app) that is loaded onto a data processing system (such as a digital signal processor or computer or mobile phone). During operation, the software is executed by the data processing system to carry out the audio signal processing functions of the circuitry as described herein in the digital domain in order to enhance an input audio signal. The input audio signal can be stored in the memory of the data processing system or possibly streamed to the data processing system via network communication.

There have been described and illustrated herein several embodiments of a method and circuitry for processing audio signals. While particular embodiments of the invention have been described, it is not intended that the invention be limited thereto, as it is intended that the invention be as broad in scope as the art will allow and that the specification be read likewise. Thus, while particular circuit elements and component values have been disclosed, it will be appreciated that other circuit elements and component values can be valid as well. It will therefore be appreciated by those skilled in the art that yet other modifications could be made to the provided invention without deviating from its spirit and scope as claimed.

What is claimed is:

1. An audio signal processing method that processes an input audio signal, comprising:

a) filtering the input audio signal with a high pass filter to produce a filtered audio signal;

b) inputting said filtered audio signal to a compressor that produces a compressor output signal;

c) producing a first intermediate audio signal based on the compressor output signal;

d) inputting said filtered audio signal to a harmonics generator that produces harmonics of said filtered audio signal;

e) producing a second intermediate audio signal based on the harmonics of the filtered audio signal;

f) producing a third intermediate signal based upon the input audio signal; and g) producing an output audio signal by combining the first intermediate audio signal, the second intermediate audio signal and the third intermediate audio signal.

2. An audio signal processing method according to claim 1, wherein:

the compressor is configured to reduce dynamic range of components of said filtered audio signal that contribute to the first intermediate audio signal relative to dynamic range of the harmonics that contribute to the second intermediate audio signal.

3. An audio signal processing method according to claim 1, wherein:

the compressor is configured to cause the harmonics that contribute to the second intermediate audio signal to become more apparent and audible in the output audio signal by reducing the dynamic range of the first intermediate audio signal.

4. An audio signal processing method according to claim 1, wherein:

the compressor is configured to cause the effect of the filtering to be more consistently audible when the first intermediate signal is combined with the third intermediate audio signal.

5. An audio signal processing method according to claim 1, wherein:

operational parameters of the compressor dynamically adjusted by user input.

6. An audio signal processing method according to claim 1, wherein:

the combining of the first intermediate audio signal, the second intermediate audio signal and the third intermediate audio signal involves mixing the first, second and third intermediate audio signals.

7. An audio signal processing method according to claim 1, wherein:

the combining of the first intermediate audio signal, the second intermediate audio signal and the third intermediate audio signal involves amplifying at least one of the first, second and third intermediate audio signals.

8. An audio signal processing method according to claim 1, further comprising:

amplifying the output audio signal.

9. An audio signal processing method according to claim 1, wherein:

the input audio signal is output from an amplifier whose input is electrically coupled to an audio source.

10. An audio signal processing method according to claim 1, wherein:

the compressor reduces dynamic range of said filtered audio signal as compared to said input audio signal at a ratio between 5 to 1 and 15 to 1.

11. An audio signal processing method according to claim 1, wherein:

the first intermediate audio signal is produced by attenuating the compressor output signal;

the second intermediate audio signal is produced by attenuating the harmonics of the filtered audio signal output by the harmonics generator; and the third intermediate audio signal is a copy of said input audio signal.

12. An audio signal processing method according to claim 11, wherein:

the attenuating of the compressor output signal and the attenuating of the input audio signal is controlled dynamically in a reciprocal fashion in accordance with user input; and the attenuating the harmonics of the filtered audio signal is controlled dynamically by user input.

13. An audio signal processing method according to claim 11, wherein:

the attenuating of said filtered audio signal causes attenuation of such filtered audio signal in a range from zero attenuation to full attenuation.

14. An audio signal processing method according to claim 11, wherein:

the attenuating of the harmonics produced by the harmonics generator causes attenuation of such harmonics in a range from 0 dB to 20 dB.

15. An audio signal processing method according to claim 1, wherein:

the audio signals processed by the method are in digital form.

16. An audio signal processing method according to claim 1, wherein:

the audio signals processed by the method are in analog form.

17. Audio signal processing circuitry that processes an input audio signal, comprising:

a) a high pass filter that filters the input audio signal to produce a filtered audio signal;

b) a compressor that compresses said filtered audio signal to produce a compressor output signal;

c) means for producing a first intermediate audio signal based upon the compressor output signal;

d) a harmonics generator with an input that receives said filtered audio signal, the harmonics generator producing harmonics of said filtered audio signal;

e) means for producing a second intermediate audio signal based on the harmonics produced by said harmonics generator;

f) means for producing a third intermediate audio signal based on said input audio signal; and g) means for producing an output audio signal by combining the first intermediate audio signal, the second intermediate audio signal and the third intermediate audio signal.

18. Audio signal processing circuitry according to claim 17, wherein:

the compressor is configured to reduce dynamic range of components of said filtered audio signal that contribute to the first intermediate audio signal relative to dynamic range of the harmonics that contribute to the second intermediate audio signal.

19. Audio signal processing circuitry according to claim 18, wherein:

the compressor is configured to cause the harmonics that contribute to the second intermediate audio signal to become more apparent and audible in the output audio signal by reducing the dynamic range of the first intermediate audio signal.

20. Audio signal processing circuitry according to claim 17, wherein:

the compressor is configured to cause the effect of the filtering to be more consistently audible when the first intermediate signal is combined with the third intermediate audio signal.

21. Audio signal processing circuitry according to claim 17, wherein:

the first intermediate audio signal is produced by attenuating the compressor output signal;

the second intermediate audio signal is produced by attenuating the harmonics of the filtered audio signal output by the harmonics generator; and the third intermediate audio signal is produced by passing said input audio signal without any signal processing being performed on said input audio signal.

22. Audio signal processing circuitry according to claim 17, wherein:

the audio signals are processed by the audio signal processing circuitry in digital form.

23. Audio signal processing circuitry according to claim 17, wherein:

the audio signals are processed by the audio signal processing circuitry in analog form.

* * * * *